United States Patent [19]

Menchetti et al.

[11] Patent Number: 5,042,213

[45] Date of Patent: Aug. 27, 1991

[54] CHANNEL UTILITY NOTCH

[75] Inventors: Robert J. Menchetti, Buffalo; Robert M. Chapman, Lockport, both of N.Y.

[73] Assignee: National Gypsum Company, Dallas, Tex.

[21] Appl. No.: 126,531

[22] Filed: Nov. 30, 1987

[51] Int. Cl.[5] ..... E04B 2/28

[52] U.S. Cl. ..... 52/481; 52/220; 52/489; 52/720

[58] Field of Search ..... 52/489, 220, 221, 238.1, 52/508, 511, 512, 658, 720, 479, 481; 29/155 R; 72/335; 228/170, 173.4

[56] References Cited

U.S. PATENT DOCUMENTS

| | | | |
|---|---|---|---|
| 1,876,528 | 9/1932 | Walters | 52/508 |
| 3,156,034 | 11/1964 | Gruetjen | 29/155 R |
| 3,173,178 | 3/1965 | Kumburis | 52/508 |
| 3,173,523 | 3/1965 | Mote | 52/508 |
| 3,478,483 | 11/1969 | Baker | 52/658 |
| 3,484,126 | 12/1969 | Hook | 52/658 |
| 3,722,163 | 3/1973 | Satkin et al. | 52/511 |
| 3,753,325 | 8/1973 | Stanley et al. | 52/489 |
| 3,844,079 | 10/1974 | Karrip | 52/221 |
| 3,867,107 | 2/1975 | Long et al. | 52/658 |
| 3,908,328 | 9/1975 | Nelsson | 29/155 R |
| 4,018,020 | 4/1977 | Sauer et al. | 52/489 |
| 4,170,858 | 10/1979 | Walker | 29/155 R |
| 4,221,038 | 9/1980 | Singer et al. | 228/173.4 |
| 4,245,448 | 1/1981 | Agar | 52/489 |
| 4,704,835 | 11/1987 | Jordan | 52/489 |
| 4,719,730 | 1/1988 | Winkowski | 52/238.1 |

FOREIGN PATENT DOCUMENTS

| | | | |
|---|---|---|---|
| 2337908 | 2/1974 | Fed. Rep. of Germany | 29/155 R |

*Primary Examiner*—Michael Safavi

*Attorney, Agent, or Firm*—Laird F. Miller; Robert F. Hause

[57] ABSTRACT

A notched metal channel having a small section of web removed and an adjacent short section of flange bent inwardly into the area of the removed section of web, and a hollow wall having such a notched channel forming part of the framing in the hollow of the wall, with elongate utilities in the wall extending substantially perpendicularly, relative to the channel, and extending between the channel notch and the adjacent wallboard forming the wall facing.

20 Claims, 3 Drawing Sheets

CHANNEL UTILITY NOTCH

BACKGROUND OF THE INVENTION

This invention relates to an improved structural channel having a novel notch for permitting utilities to extend from one side of the channel to the other side and to a wall construction embodying the novel channel.

U.S. Pat. No. 4,245,448 discloses a form of hollow partition wall which includes a plurality of horizontally extending metal channels, with gypsum wallboards hung, by special suspension clip assemblies, from the metal channels. The presence of a continuous metal channel extending horizontally between adjacent vertical studs precludes the placing of certain vertically extending utilities through the hollow space between opposed wallboards, such as elongate metal conduit or metal pipe. Large holes can be cut in the web of the channel, as are shown in U.S. Pat. No. 4,245,448, but such holes are extremely difficult to feed conduit or pipe up through.

Means for providing equally large passageways from one side to the other side of such horizontal channels, with removal of substantially less metal from the channel, and forming the passageways along the sides of the channels, where conduit can be essentially just laid against the side of the channel, would thus be highly desirable.

SUMMARY OF THE INVENTION

The present invention contemplates forming an elongate metal channel with a notch in the side which is formed by removal of a small amount of metal from the channel web, or a severing of the metal of the web, which removal or severing is located closely adjacent the junction of the channel web and a channel flange, and then by bending the channel flange inwardly, adjacent the area of removal or severing.

It is an object of the invention to provide an improved form of metal channel with an inwardly bent notched side, for providing space in a wall for utilities.

It is a further object of the invention to provide a novel hollow wall having horizontal metal channels extending through openings in the webs of vertical studs, wherein such channels have novel improved notches in the side, for placement of utilities.

It is a still further object to provide a novel method of making notched channels for use in hollow partitions requiring passageways for utilities.

These and other objects and advantages of the invention will be more fully apparent when considered in relation to the preferred embodiments thereof as set forth in the specification and as shown in the drawings in which.

DESCRIPTION OF THE PREFERRED EMBODIMENTS

Figure 1:
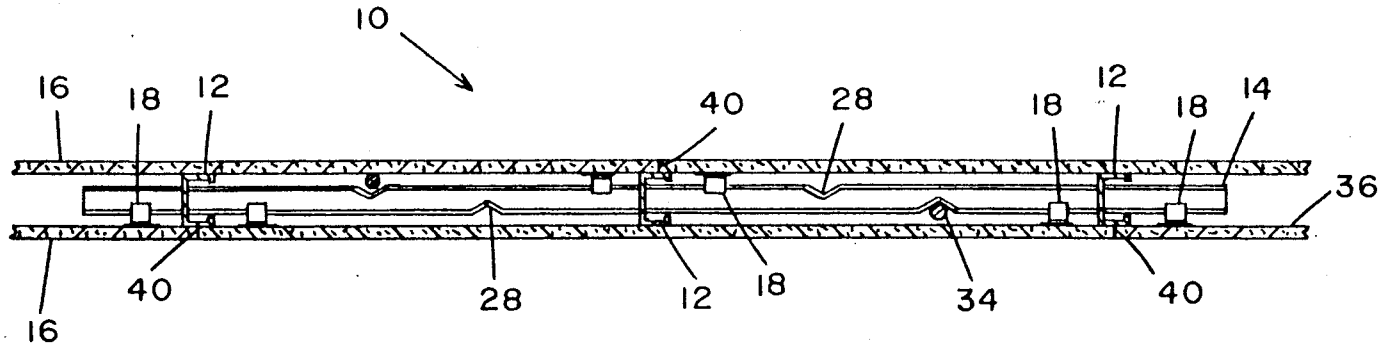
FIG. 1 is a sectional plan view of a five foot length of metal channel formed with notches formed in each side, in accordance with the invention, disposed within a hollow wall.

Referring to FIG. 1, there is shown a section of a hollow wall 10, including vertical metal studs 12, a five foot length of upwardly opening, horizontally extending metal channel 14, and a plurality of gypsum studs 12 by suspension assemblies 18, which support the wallboards 16 affixed against the two opposed faces of wallboard on channel 14.

The metal channel 14 has a horizontal web 20 and two upwardly extending side flanges 22, 22. Each of the side flanges 22, 22 have two inwardly extending V-bends 24, 24, each located over an inwardly extending triangular shaped cut-out 26, 26 in the side edge portion of the web 20. Each V-bend 24 and associated cut-out 26 forms a V-shaped notch 28 extending inwardly into the metal channel 14.

Figure 2:
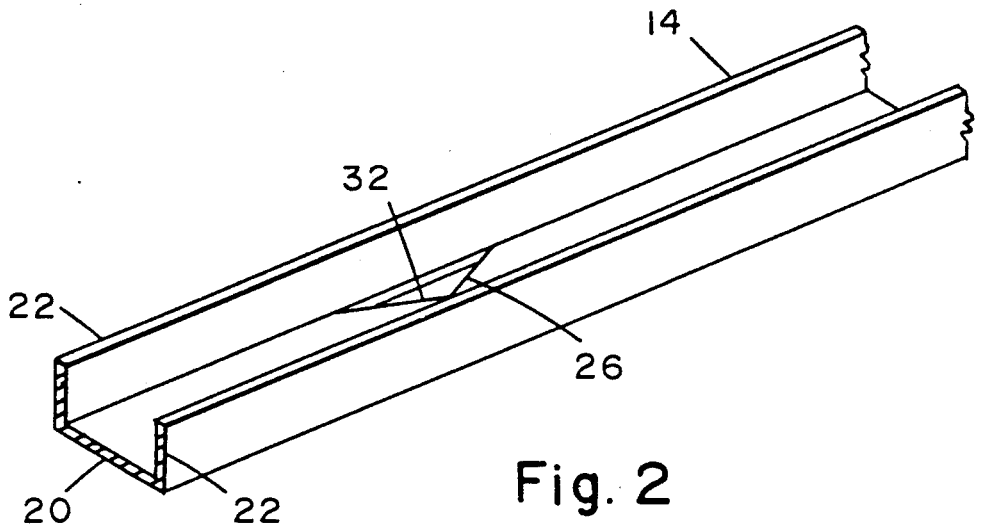
FIG. 2 is an isometric view of a short section of metal channel with a knock-out in the web prior to bending the flange to form a notch.
Figure 3:
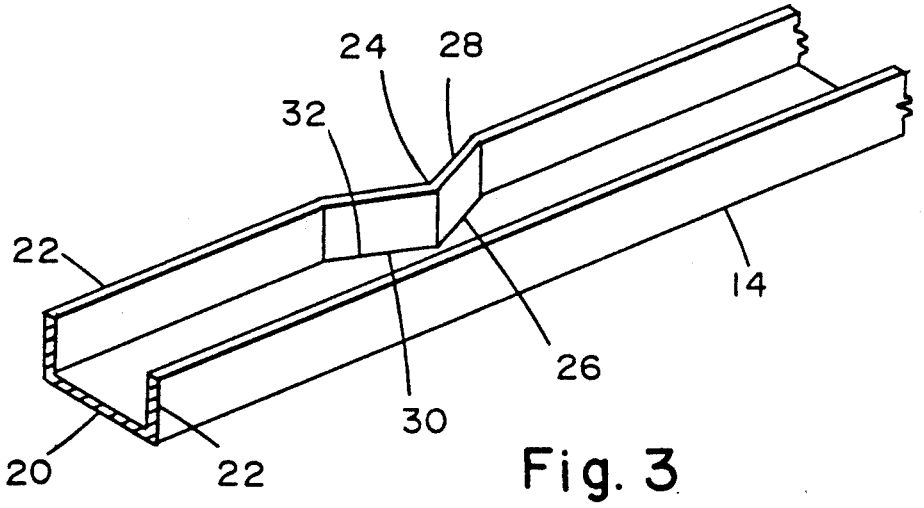
FIG. 3 is an isometric view of the metal channel section of F 2 with the flange bent to form a notch.

FIGS. 2 and 3 show how each notch 28 is formed. A triangular shaped cut-out 26 is first formed near the side edge of the web 20, by removal of a triangular section of web 20. The flange 22 is then bent inwardly until the bottom edge 30 of the flange 22 adjacent the cut-out 26 is pressed against the V-shaped inner edge 32 of the cut-out 26.

Figure 4:
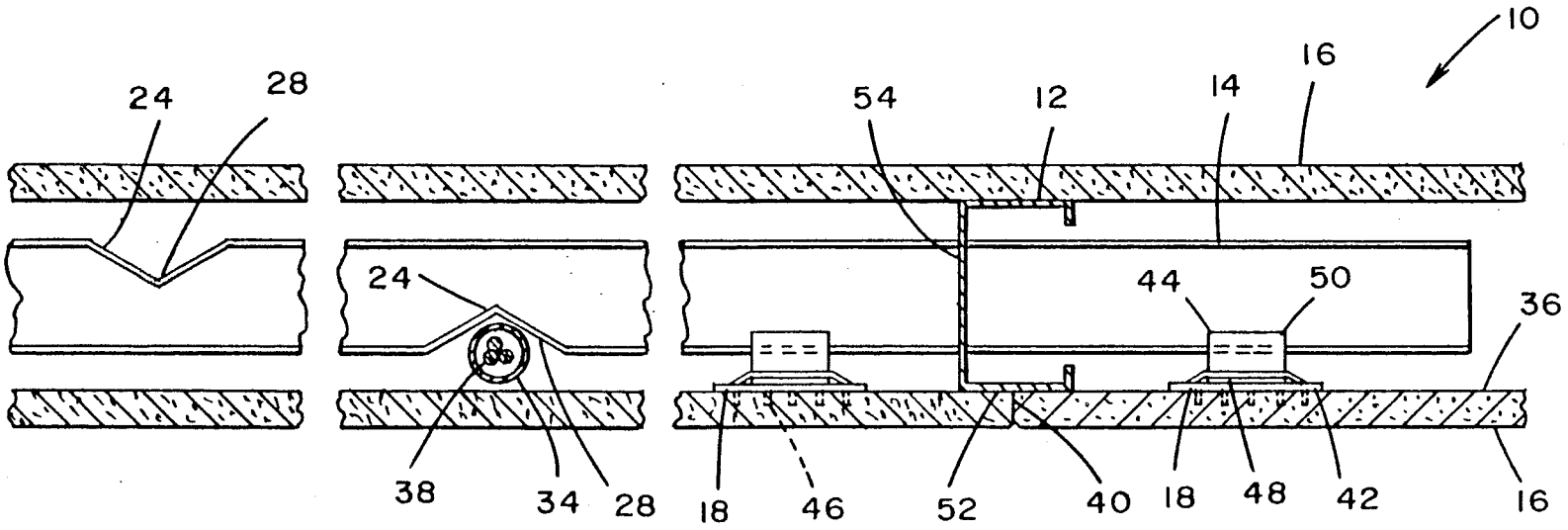
FIG. 4 is a sectional plan view enlarged of the right end portion of the hollow wall of FIG. 1.

FIG. 4 shows an enlarged view of the right end of the section of wall 10 of FIG. 1, showing, in section, hollow metal conduit 34 extending vertically within the hollow cavity of hollow wall 10 and extending between a notch 28 and the back side 36 of an adjacent piece of wallboard 16. Wire 38 is shown within conduit 34.

The suspension assemblies 18 are shown, one adjacent each side of the stud 12 in FIG. 4. As will be noted in FIG. 1, the gypsum wallboards 16, which are normally four feet wide, are disposed with joints 40, between wallboards, located over alternating studs 12, spaced two feet apart, with the joints 40 on one side of wall 10 on different studs 12 than the joints 40 on the opposite side of the wall 10. Suspension assemblies 18, shown enlarged in FIG. 4, include a gang nail plate 42 and a suspension clip 44 and are more completely disclosed in U.S. Pat. No. 4,245,448, which disclosure is hereby incorporated by reference.

In a preferred form, the wall 10 includes channels 14 spaced apart equally between a floor and a ceiling. Each wallboard 16 has three gang nail plates 42 spaced apart equally between a floor and a ceiling, on each vertical edge of the wallboard. The gang nail plates 42 are affixed to the back side 36 of the wallboards 16 by driving wallboard piercing tangs 46, which project rearwardly from the plate 42, into the wallboards 16. The suspension clip 44 has an upper portion 48 attached to plate 42, and a lower portion 50 inclined outwardly from the plane of the plate 42 such that it extends over a flange 22 of the channel 14.

Thus to install the wallboards 16 onto the supporting structure, the wallboard 16, with suspension assembly 18 attached, is lifted so each of six suspension clips 44 is engaged in its respective channel 14. When the wallboard 16 is suspended from the clips 14, the wallboard 16 is held tight against the face 52 of each respective vertical stud 12.

The wallboard 16 may be removed from the structure by lifting the wallboard 16 upward to disengage the clips 44 from the channels 14.

In accordance with the invention, conduit 34, or any other vertically extending elongate utility element is put in place by simply placing the conduit adjacent the notches 28 of one or more horizontal channels 14 prior to suspending the respective wallboard 16 on the channels 14. Alternatively, if new conduit 34 L is desired after the wallboard 16 has already been suspended on the channels 14, the wallboard can be simply removed from the structure, new conduit 34 can be placed adjacent notches 28 not already in use, and the wallboard 16 can then be simply resuspended on the channels 14.

Figure 5:
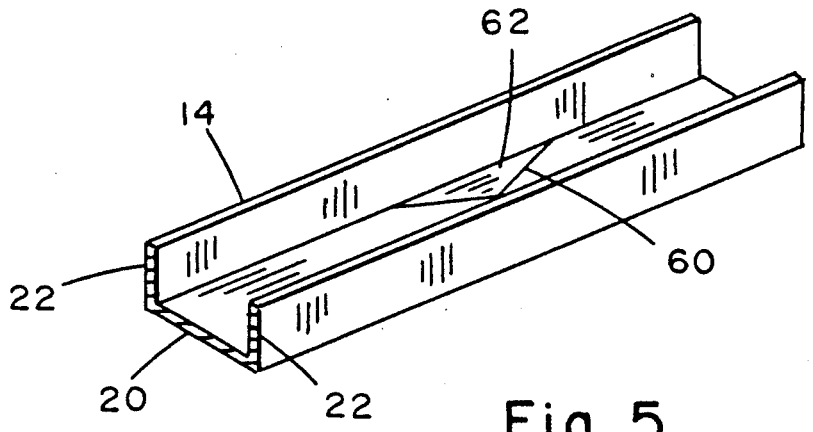
FIG. 5 is an isometric view of a short section of metal channel with a V-shaped cut in the web prior to bending the cut-out section out of the plane of the web.
Figure 6:
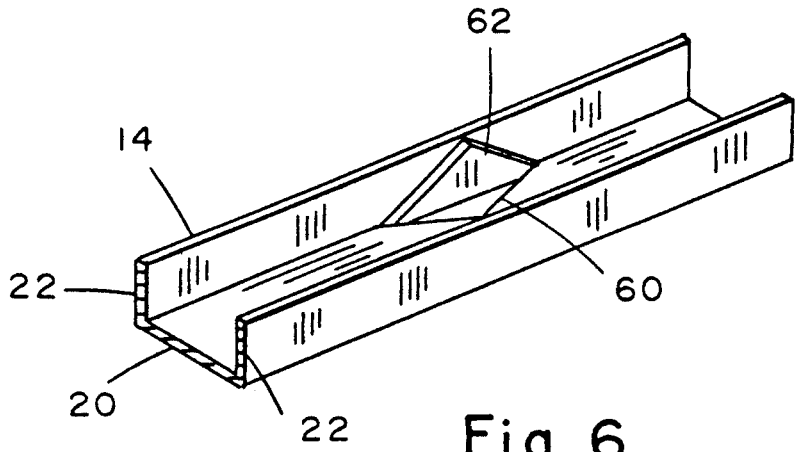
FIG. 6 is an isometric view of the metal channel section of FIG. 5 after the section of web defined by the V-cut is bent parallel to the plane of the adjacent flange and prior to bending the flange to form a notch.
Figure 7:
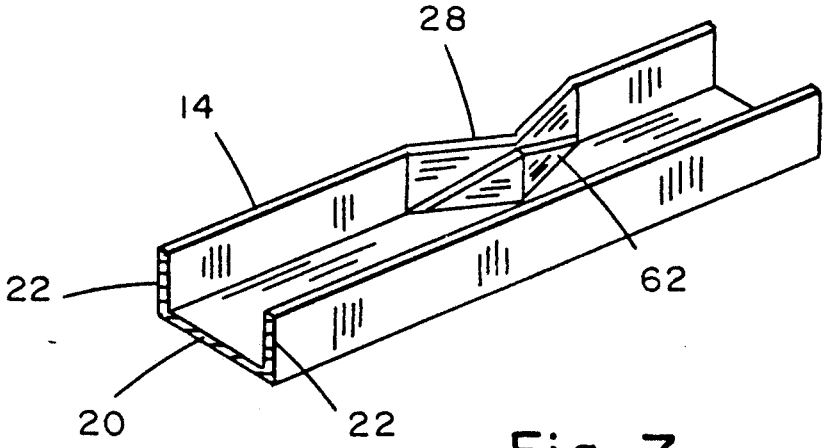
FIG. 7 is an isometric view of the metal channel section of FIGS. 5 and 6 with the flange and adjacent bent-up section of web both bent inwardly to form a notch.

It is further contemplated, within the invention, that the notch 28 can be formed by cutting a V-shaped cut 60 in the bottom web 20 of a channel 14, see FIG. 5, and, instead of removing a triangular section of metal from the web 20, simply bending a triangular section 62 of metal into a plane parallel to the plane of the adjacent flange 22, see FIG. 6. The flange 22 and the triangular section 62 of web material can then be bent inwardly, see FIG. 7, similar to the manner in which the above described V-bend 24 was formed.

As shown in FIG. 1, each sixty inch channel 14 extends through cutouts in the webs 54 of three studs 12. The studs 12 are spaced apart two feet, and the notches 28 are located in slightly offset positions, one to another, approximately half way between adjacent studs 12. The channel 14 has a web 20 width of about one-and-a-half inches, a flange 22 height of about three quarters of an inch, a notch 28 length of about two inches and a notch 28 depth of about one-half inch. With a notch 28 depth of one-half inch, a space is formed between the notch 28 and the wallboard back side 36 sufficient to extend conduit 34 therebetween of diameters up to about one inch.

Having completed a detailed disclosure of the preferred embodiments of our invention, so that others may practice the same, we contemplate that variations may be made without departing from the essence of the invention.

We claim:

1. A notched channel comprising an elongate straight channel having an elongate flat web and elongate first and second perpendicularly directed flanges extending from each edge of said flat web forming an elongate junction between each said flange and said web, said flat web having at least one inwardly directed cut-out section, closely adjacent said junction of said web and said first one of said flanges, removed from said web, and said first one of said flanges having a laterally extending inward bend disposed only adjacent said cut-out section, forming a laterally extending notch in the channel, said second of said flanges being unbent opposite to said notch, whereby a short longitudinal section of said channel at said inward bend is relatively narrower completely laterally across than longitudinally adjacent sections of said channel.

2. A notched channel as defined in claim 1 wherein said removed section of web is disposed in a bent position, said bent position being perpendicular to said web.

3. A notched channel as defined in claim 1 wherein said removed section of web is completely removed from said channel.

4. A notched channel as defined in claim 1 wherein said removed section of web has a substantially triangular shaped form.

5. A notched channel as defined in claim 4 wherein said inwardly bent flange section is substantially a V-shaped bend, forming a V-shaped notch in said channel.

6. A notched channel as defined in claim 1 wherein the edge of said flange at said removed section of web is bent inwardly into contact with a cut portion of said web.

7. A notched channel as defined in claim 1 wherein said channel is approximately five feet long and has two pairs of notches.

8. A notched channel as defined in claim 7 wherein said two pairs of notches are disposed each about a foot-and-a-half in from an end of said channel.

9. A notched channel as defined in claim 8 wherein the two notches in each pair of notches are spaced slightly apart along the length of said channel.

10. A notched channel as defined in claim 1 wherein said notch has a depth of about one-half inch.

11. A hollow wall having a supporting structure comprising a plurality of vertical studs, wallboards mounted against said studs, and a plurality of horizontally extending, upwardly opening notched metal channels, each said notched channel having an elongate flat web and elongate first and second perpendicularly directed flanges extending from each edge of said flat web forming an elongate junction between each said flange and said web, said flat web having at least one inwardly directed cut-out section, closely adjacent said junction of said web and said first one of said flanges, removed from said web, and said first one of said flanges having a laterally extending inward bend disposed only adjacent said cut-out section, forming a laterally extending notch in the channel, said second of said flanges being unbent opposite to said notch, whereby a short longitudinal section of said channel at said inward bend is relatively narrower completely laterally across than longitudinally adjacent sections of said channel, said notches in said channels forming relatively wide passageways between said channels and said wallboards whereby utility elements can be disposed to extend through said passageways.

12. A hollow wall as defined in claim 11 wherein said notched channels extend through cutouts in the webs of a plurality of said studs.

13. A hollow wall as defined in claim 12 wherein each said notched channel extends through cutouts in the webs of three of said studs.

14. A hollow wall as defined in claim 13 wherein each said notched channel has a pair of notches between each pair of adjacent studs supporting said channel, each said pair of notches including one notch in each said first and second flanges.

15. A hollow wall as defined in claim 14 wherein said notches in each of said pair of notches are spaced apart slightly along the length of said channel.

16. A hollow wall as defined in claim 15 wherein said notched channel is about five feet long and said studs are spaced apart about two feet.

17. A hollow wall as defined in claim 11 wherein said wallboards are affixed to said supporting structures by being suspended from said notched channels.

18. A hollow wall as defined in claim 17 wherein each said notched channel extends through cutouts in the webs of three studs.

19. A hollow wall as defined in claim 18 wherein said notched channels have a notch in each channel between each pair of adjacent studs supporting said channel.

20. A hollow wall as defined in claim 19 wherein said channel is about six feet long, one-and-a-half-inch wide and has notches of about two-inch length and about a half-inch depth.

* * * * *

UNITED STATES PATENT AND TRADEMARK OFFICE

CERTIFICATE OF CORRECTION

PATENT NO. : 5,042,213

DATED : August 27, 1991

INVENTOR(S) : Robert J. Menchetti; Robert M. Chapman

It is certified that error appears in the above-identified patent and that said Letters Patent is hereby corrected as shown below:

Col. 1, line 66: After "of" the letter "F" should be --Fig.--.

Col. 2, line 18: After the word "gypsum" and before the word "studs" insert --wallboards 16 affixed against the two opposed faces of--.

Col. 2, lines 19-20: Delete the wording "wallboards 16 affixed against the two opposed faces of".

Col. 3, line 14: After the number "34" and before the word "is", delete the "L".

Col. 3, line 51: Before the word "channel", insert --metal--.

Signed and Sealed this

Sixth Day of October, 1992

*Attest:*

*Attesting Officer*

DOUGLAS B. COMER

*Acting Commissioner of Patents and Trademarks*